US005305851A

United States Patent [19]

Katson et al.

[11] Patent Number: 5,305,851

[45] Date of Patent: Apr. 26, 1994

[54] SAFETY LADDER

[76] Inventors: George A. Katson, 1117 W. Washington St.; Michael D. Katson, Rte. 4, Box 40-A, both of Grafton, W. Va. 26354

[21] Appl. No.: 815,979

[22] Filed: Jan. 2, 1992

[51] Int. Cl.[5] ..... E06C 7/00

[52] U.S. Cl. ..... 182/204; 182/111

[58] Field of Search ..... 182/204, 205, 201, 211, 182/166, 111

[56] References Cited

U.S. PATENT DOCUMENTS

| | | | |
|---|---|---|---|
| 1,609,257 | 11/1926 | Lazear | 182/205 |
| 3,428,147 | 2/1969 | Gordon | 182/204 |
| 3,474,883 | 10/1969 | Weis | 182/204 X |
| 3,948,352 | 4/1976 | Larson et al. | 182/204 |
| 4,311,210 | 1/1982 | Jackson | 182/204 X |

*Primary Examiner*—Karen J. Chotkowski

*Attorney, Agent, or Firm*—Reed Smith Shaw & McClay

[57] ABSTRACT

The present invention provides a safety ladder in which at least one leg of the ladder is adjustable in length to accommodate an uneven terrain.

9 Claims, 3 Drawing Sheets

SAFETY LADDER

FIELD OF THE INVENTION

This invention relates to novel safety ladders and more particularly relates to a novel ladder which can be leveled upon almost any surface regardless of irregularities in that surface.

BACKGROUND OF THE INVENTION

Modern ladders are of two general types, step ladders and extension ladders. Step ladders are ordinarily folding and have an A-shaped configuration, one side of which has a series of steps. Extension ladders, on the other hand, have two straight sections juxtaposed in parallel planes. These sections can be compressed for storage or transportation and subsequently extended to a desired length during use.

Because of the nature of the work for which step ladders and extension ladders are used, both types of ladders are often used upon surfaces which are uneven or irregular. Placing such ladders on irregular surfaces results in a substantial decrease in the stability of the ladder. The instability created increases with increasing ladder height.

To improve the stability of ladders under such conditions, workmen often place an object such as a rock or a wooden board under the bottom of one or more of the legs. While such spacers may level the ladder at a particular position, moving the ladder to another location may change the inclination of the base surface, requiring readjustment with different spacers. In addition to the time expended finding and positioning adequate spacers, movement of such unanchored spacers during use of the ladder can result in serious injuries. There is thus a great need to develop an apparatus to safely level ladders upon irregular surfaces.

A number of ladder leveling devices have been developed in an attempt to overcome the above problems. U.S. Pat. No. 4,029,174, for example, discloses a ladder designed for standing upon an incline or other uneven surface. The ladder is equipped with a metal block secured to a lower end of each leg. Each block has a threaded vertical opening in which a threaded extension is vertically adjustable. If the ground is sloped at an angle, one extension may be screwed into a lower position than the other so that both extensions rest firmly on the ground without the ladder being sidewardly inclined.

Similarly, U.S. Pat. No. 3,937,298, discloses an attachment for extension ladders which adjusts to uneven terrain. The attachment includes a pair of open-ended sockets mounted at opposite ends of a transverse member which is attached to the rails of an extension ladder. Two independently adjustable legs are slideably received, each in a receptive socket outward of the rails. A latching element associated with each socket locks one leg in a position of adjustment.

U.S. Pat. No. 4,683,983 also discloses a ladder leveling apparatus including a frame portion, a support portion, a slider portion, a retainer portion and a positioning portion. The frame portion includes an elongated U-shaped section having a main section of a width slightly larger than the width of a ladder leg. The slider portion includes a guide member disposed within a channel on the main section. The retainer portion is positioned over the guide member. A bolt extends through an opening in the retainer portion and a corresponding opening in the guide member. The bolt further extends beyond the main section a distance sufficient to pass through an opening across the thickness of the ladder leg and beyond. The positioning portion of the leveling device includes a traverse pin member that extends through aligned openings in the side sections of the frame portion.

Because of various shortcomings, however, no prior ladder leveling system has gained widespread acceptance. Some of these systems are very difficult to adjust for a number of reasons. These systems, for example, generally provide an adjustable leveling means only at the base of the ladder leg. Such designs require the user of the ladder to either adjust the leveling device while the ladder is on its side or to adjust the ladder while kneeling on the ground. Such inconvenience often causes the user to forego using the leveling system even if the ladder is equipped with such a system.

Other systems do not provide sufficient stability for safe use. Still others are too expensive to produce.

The present invention provides a novel safety ladder which overcomes the deficiencies of earlier devices. The present safety ladder provides a high degree of safety for the user, while being easily adjustable to quickly conform to almost any irregular surface.

Moreover, the present ladder is simple in design and can be produced relatively inexpensively. Current ladder manufacturing systems can easily be modified to manufacture the present ladder, and commercially available material and components can be used in the manufacture.

SUMMARY OF THE INVENTION

Generally, the present invention is a ladder comprising at least two lateral legs. At least one of the legs comprises a stationary element and a slideable element. The slideable element comprising a transverse section of slightly greater width than a corresponding transverse portion of the stationary element. The slideable element also is equipped with two lateral sections, one of the two lateral sections disposed at each lateral end of the transverse section. Each of the two lateral sections is slightly wider than a corresponding lateral portion of the stationary element. Each lateral section also has an abutment means disposed thereon at an edge of the lateral section distant from the transverse section. The slideable element thus has a modified U-shape operable to be slideably disposed upon the stationary element with substantially minimal transverse movement. The ladder also comprises a means for attaching the slideable element to the stationary element at a position thereon so that the length of the leg is adjustable to substantially level the ladder.

The ladder can either be a step ladder or an extension ladder. Moreover, more than one leg of the ladder may be adjustable. In a preferred embodiment, each of the legs of the ladder comprises a stationary element and an adjustable slideable element. In another preferred embodiment, the slideable element includes a base portion which is relatively finely adjustable to provide length adjustment in addition to that provided by the adjustment of the slideable element.

DETAILED DESCRIPTION OF THE INVENTION

Figure 1:
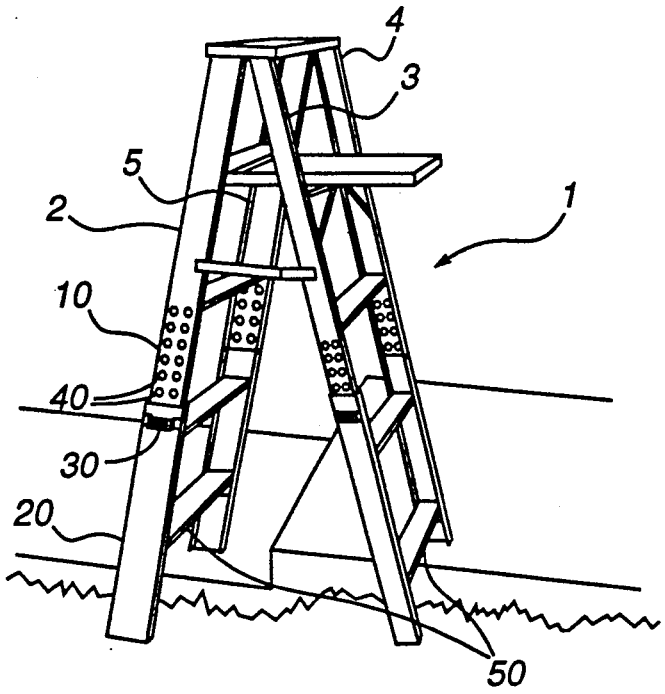
FIG. 1 is a side prospective view an embodiment of the present ladder showing each of four legs of a step ladder adjustable to accommodate an irregular surface.

Referring to FIG. 1, a preferred embodiment of the present invention is shown in a step ladder 1. In this embodiment, each of four legs 2, 3, 4 and 5 of step ladder 1 are adjustable to accommodate unlevel terrain L. Legs 2, 3, 4 and 5 of ladder 1 comprise an inner stationary element 10 and an outer slideable element 20.

Slideable element 20 is of a modified U-shaped structure. Slideable element 20 comprises a transverse section 21, lateral sections 22 and 23 and abutment sections 24 and 25. Transverse section 21 is slightly wider than corresponding transverse portion 11 of stationary element 10. Likewise, lateral section 22 and 23 are slightly wider than corresponding lateral portions 12 and 13 of stationary element 10. Abutment members 24 and 25 are position at the distal ends of lateral sections 22 and 23 so that slideable element 20 is slideably disposed on stationary element 10 but motion of slideable element 20 in any direction other than parallel to stationary element 10 (i.e. transverse and lateral motion) is effectively minimized or eliminated. Elimination of such transverse and lateral motion is essential to the stability of ladder 1.

To provide for ease of adjustment, slideable element 20 is preferably of sufficient length to allow adjustment of the position of slideable element 20 while the ladder is in an upright position and without requiring the user to kneel upon surface L. Moreover, the stability of ladder 1 is increased by maximizing the amount of slideable element 20 that remains in contact with stationary element 10 when slideable element 20 is extended beyond stationary element 10 to effectively lengthen legs 2, 3, 4 and 5 of ladder 1. For these reasons, it is preferable that slideable element 20 be attached to stationary element 10 at a point relatively high on stationary element 10 (using the top of ladder 1 as a reference point). Preferably, slideable element 20 remains in contact with at least 20% of stationary element 10. More preferably, slideable element 20, remains in contact with at least 30% of stationary element 10. Most preferably, slideable element 20 remains in contact with at least 40% of stationary element 10.

The bottommost steps 50 of ladder 1 are preferably placed near the bottom of stationary element 10 to ensure that the first step of the user is not overly long when slideable element 20 is extended to adjust to terrain L.

Figure 2:
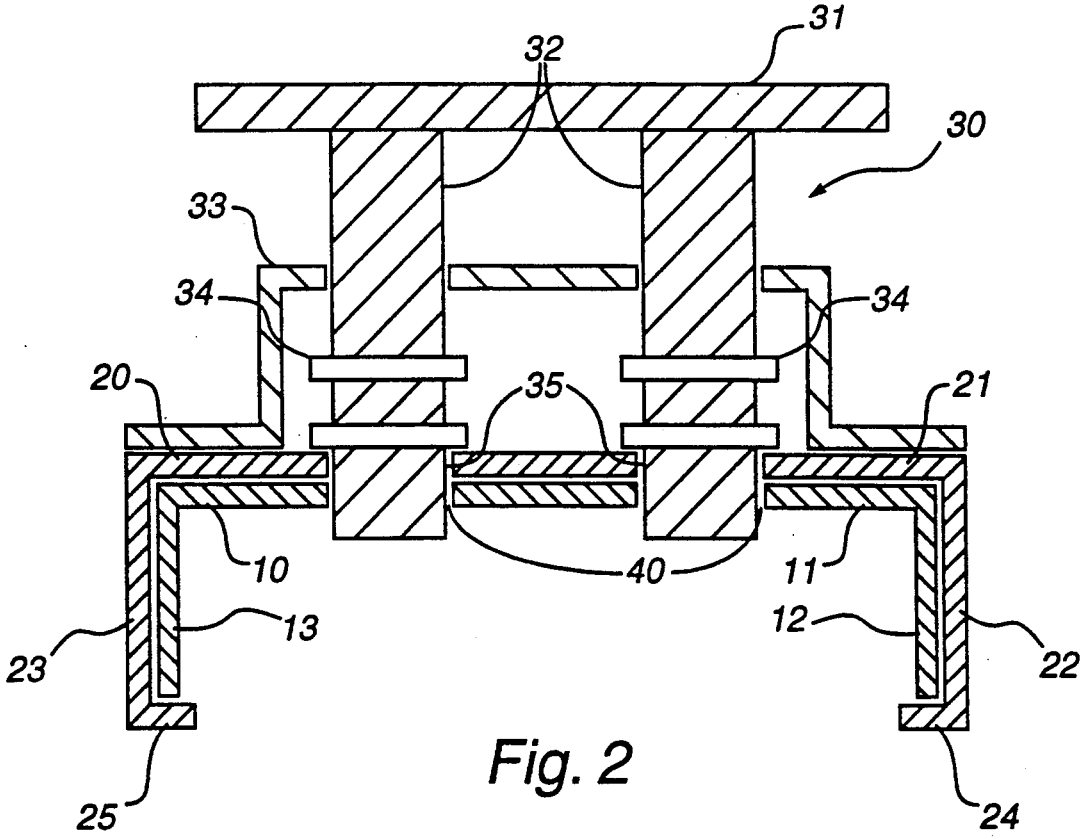
FIG. 2 is a top view in cross-section of an embodiment of a leg of the present ladder illustrating the modified U-shaped slideable element and the attachment means.

To attach slideable element 20 at a desired position upon stationary element 10, ladder 1 preferably includes attachment means 30. Attachment means 30 is preferably designed to allow simple and quick attachment upon proper positioning. A preferred embodiment of attachment means 30 is best illustrated in FIG. 2. In this embodiment, attachment means 30 comprises at a gripping means 31 to which at least one dowel rod 32 is attached. Two such dowel rods 32 are shown in FIG. 2. Dowel rods 32 are disposed within housing 33 and are biased via biasing means 34, which preferably comprise springs.

Figure 3:
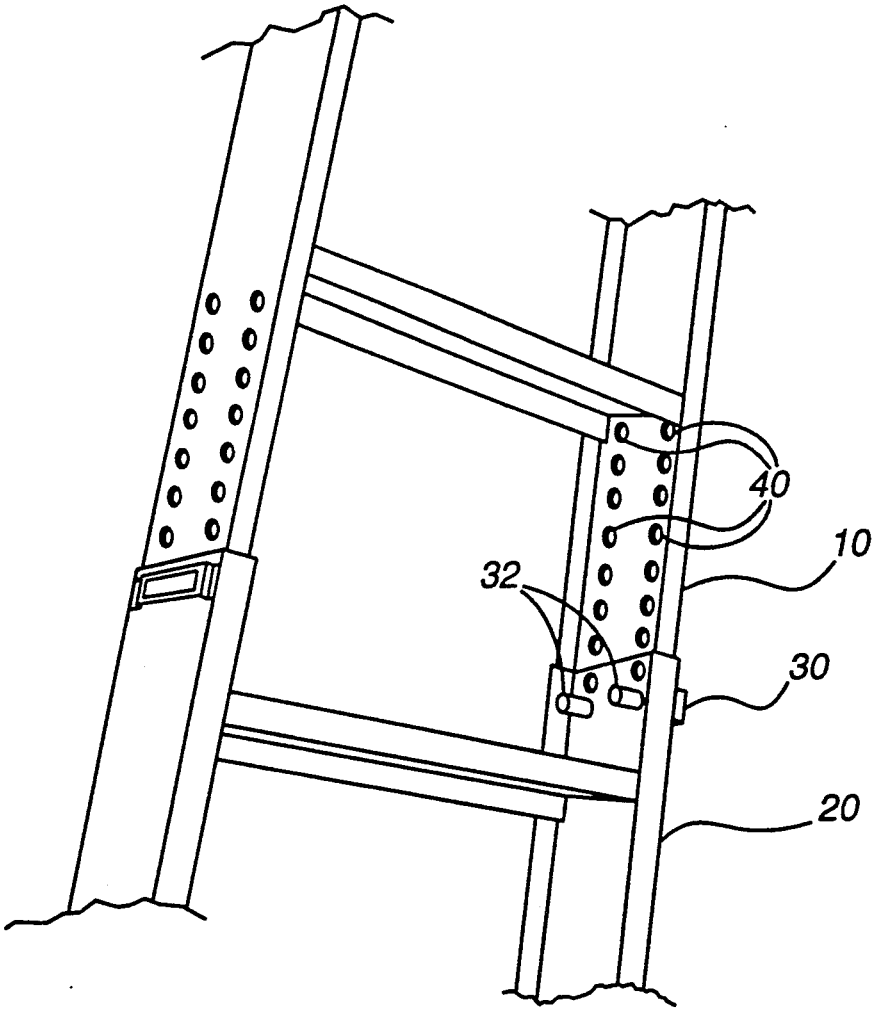
FIG. 3 is a prospective view of the present ladder showing an inner portion of a leg of the ladder and the attachment means.

In practice, slideable element 20 is adjusted to an appropriate position as determined by terrain L. Slideable element 20 is then locked into that position by placing dowel rods 32 of attachment means 30 through holes 35 of transverse section 21 of slideable element 20 and through corresponding holes 40 of transverse portion 11 of stationary element 10 as illustrated on FIGS. 2 and 3. Dowel rods 32 are biased in the locked position via biasing means 34 to prevent dislocation when jarred.

Various other attachment means such as ratcheting means or other means known in the art can be used. The preferred embodiment described above, however, has the advantages of simplicity of use and simplicity of construction.

Preferably, sufficient holes 40 are disposed in transverse portion 11 to provide a wide range of adjustment of the position of slideable element 20 and thereby the length of legs 2, 3, 4 and 5. A certain distance must be maintained between holes 40 in transverse portion 11, however, to maintain the structural integrity of transverse portion 11. For this reason, each leg of the present ladder preferably also includes a base portion 100 that is relatively finely adjustable to provide length adjustment capability in addition to that provided by holes 40 in transverse portion 11. Base portion 100 preferably provides for continuous length adjustment.

Figure 4:
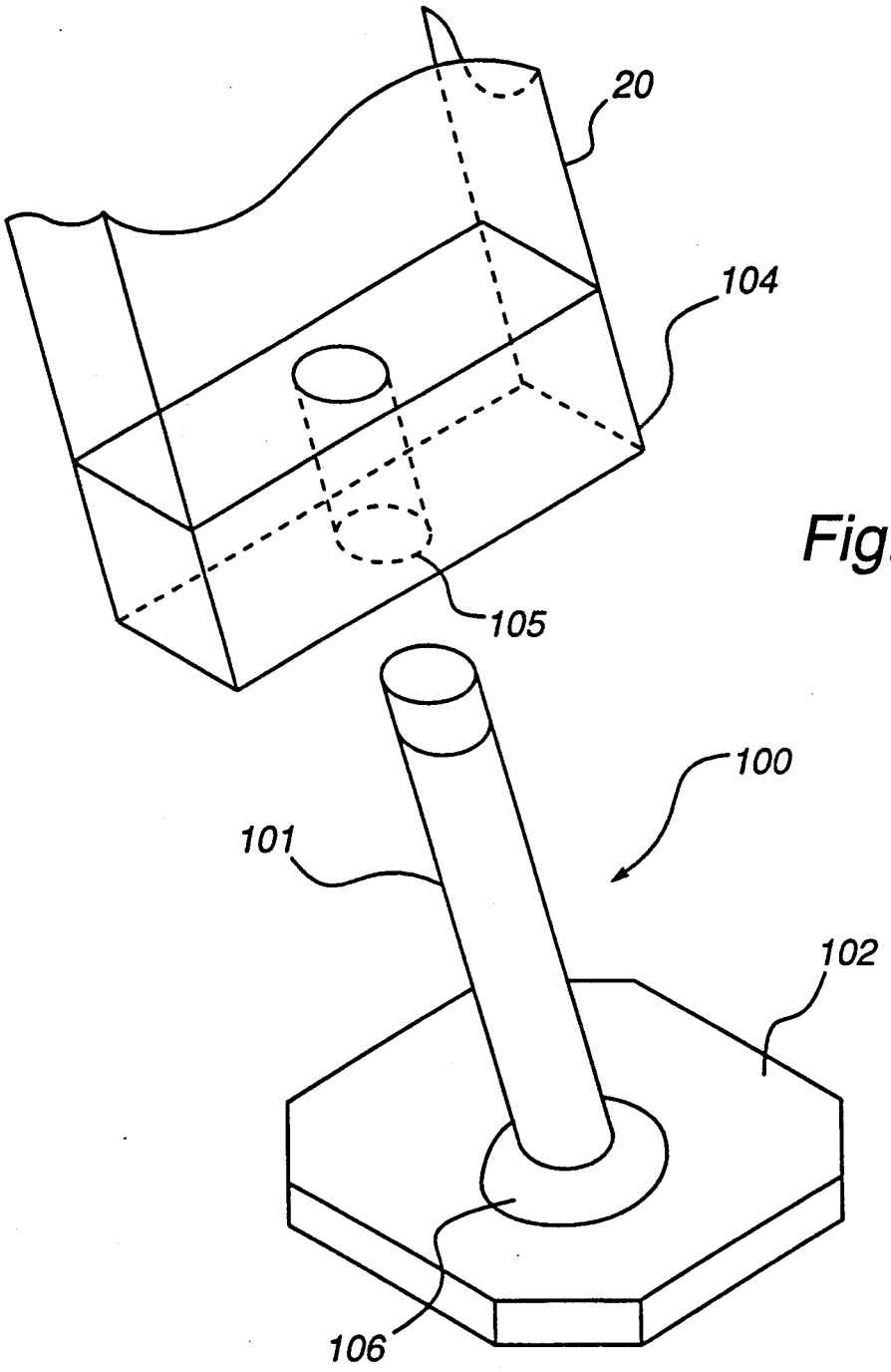
FIG. 4 is a perspective view of an embodiment of the base portion and the bottom portion of the slideable element.

Base portion 100 is illustrated in FIG. 4. In the embodiment of FIG. 4, base portion 100 preferably comprises a threaded element 101 (threading not shown) and a supporting element 102 connected to the bottom of threaded element 101. Base portion 100 is attached to the bottom 104 of slideable element 20 via threaded bore hole 105 (threading not shown). By appropriately rotating threaded element 101 within bore hole 105 the length of the ladder leg can be continuously adjusted to "fine tune" the length to terrain L.

Preferably, threaded element 101 is connected to supporting element 102 in a manner so that supporting element 102 may swivel and thus rest substantially evenly upon terrain L. This swiveling motion is preferably accomplished via an connecting means 106 such as a ball and socket attachment.

Ladder 1 can be constructed of a number of materials including wood, fiberglass, various metals and other materials commonly used in ladders. Preferably, ladder 1 is constructed of metal so that the dimensions of stationary element 20 and slideable element 21 can be appropriately tooled to provide a smooth sliding action with a minimum of transverse and lateral motion over the lifetime of ladder 1.

While presently preferred embodiments have been described in detail, the invention may be otherwise embodied within the scope of the appended claims.

What is claimed is:

1. A ladder comprising: at least two lateral legs, at least one of the legs comprising a stationary element and a slideable element, the slideable element comprising a transverse section of slightly greater width than a corresponding transverse portion of the stationary element, the slideable element further having two lateral sections, one of the two lateral section being disposed at each lateral end of the transverse section, each of the two lateral sections being slightly wider than a corresponding lateral portion of the stationary element, each lateral section of the slideable element having an abutment means disposed thereon at an edge of the lateral section distant from the transverse section, the slideable element thereby having a modified U-shape operable to be slideably disposed upon the stationary element with substantially minimal transverse and lateral motion, the ladder further comprising a means for attaching the slideable element to the stationary element at a position thereon so that the length of the at least one leg is adjustable to substantially level the ladder, said attachment means being positioned so that at least 40% of the stationary element remains in contact with the slideable element after adjustment of the at least one leg, thereby stabilizing the ladder when the at least one leg is in an extended position, a bottommost step of the ladder being placed near the bottom of the stationary element to reduce a first step required of a user of the ladder.

2. The ladder of claim 1 wherein the attachment means comprises at least one dowel rod operable to be placed through a hole disposed within the slideable element and through a corresponding hole in the stationary element appropriately positioned to effect the desired length of the leg.

3. The ladder of claim 2 wherein the stationary element has a number of holes disposed therein appropriately positioned to provide for a number of attachment positions.

4. The ladder of claim 2 wherein the dowel rod is biased in a locked position.

5. The ladder of claim 1 wherein each of the legs of the ladder is of adjustable length substantially in a manner described in claim 1.

6. The ladder of claim 1 further comprising a base portion attached to the bottom of the slideable element, the base portion including a means for more finely adjusting the length of the leg than provided by movement of the slideable element.

7. The ladder of claim 6 wherein the means for more finely adjusting the length of the leg comprises a threaded element.

8. The ladder of claim 7 wherein the base portion further comprises a supporting element for contacting a terrain upon which the leg is to rest, the supporting element being attached to the threaded element by an connecting means allowing the supporting element to swivel, thereby allowing the supporting element to better conform to the terrain.

9. The ladder of claim 8 wherein the connecting means comprises a ball and socket means.

* * * * *